US005723846A

United States Patent [19]

Koether et al.

[11] Patent Number: 5,723,846

[45] Date of Patent: Mar. 3, 1998

[54] MULTIPROBE INTELLIGENT DIAGNOSTIC SYSTEM FOR FOOD-PROCESSING APPARATUS

[75] Inventors: Bernard J. Koether, Tequesta, Fla.; Richard J. Mangini, Brookfield, Conn.

[73] Assignee: Technology Licensing Corporation, Tequesta, Fla.

[21] Appl. No.: 501,211

[22] Filed: Jul. 11, 1995

[51] Int. Cl.[6] ..... H05B 1/02

[52] U.S. Cl. ..... 219/497; 219/488; 219/508; 219/506; 219/483; 432/102

[58] Field of Search ..... 219/494, 497, 219/499, 501, 411–413, 506, 488, 507, 508, 483, 486; 307/117; 432/102, 103

[56] References Cited

U.S. PATENT DOCUMENTS 4,314,143 2/1982 Bilstad et al. ..... 219/497
4,458,140 7/1984 Belinkoff ..... 219/497
4,726,514 2/1988 Adam ..... 237/2 A
4,782,445 11/1988 Pasquini ..... 364/400
4,866,559 9/1989 Cobb, III et al. ..... 361/103
5,361,215 11/1994 Tompkins et al. ..... 364/505

*Primary Examiner*—Mark H. Paschall
*Attorney, Agent, or Firm*—Pennie & Edmonds LLP

[57] ABSTRACT

A multiprobe diagnostic system for a cooking appliance using one or more heating elements, one or more error-detecting temperature sensors located near the heating element(s), one or more control temperature sensors spaced away from the error-detecting temperature sensors, and a microcomputer program for identifying and setting error conditions in the appliance based on comparisons in temperature and temperature differentials in the appliance with minimum and maximum predetermined or learned values. Other devices, such as current sensors, are used in conjunction with temperature sensors to augment the diagnostic information obtained from the temperature sensors.

48 Claims, 15 Drawing Sheets

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| STATE I= INVALID | | | | | | | | | I | I | | | I | I | | |
| CONVECTION HEAT DEMAND | 0 | 0 | 0 | 0 | 0 | 0 | 0 | 0 | 1 | 1 | 1 | 1 | 1 | 1 | 1 | 1 |
| CONVECTION HEAT | 0 | 0 | 0 | 0 | 1 | 1 | 1 | 1 | 0 | 0 | 0 | 0 | 1 | 1 | 1 | 1 |
| CONVECTION BLOWER DEMAND | 0 | 0 | 1 | 1 | 0 | 0 | 1 | 1 | 0 | 0 | 1 | 1 | 0 | 0 | 1 | 1 |
| CONVECTION BLOWER | 0 | 1 | 0 | 1 | 0 | 1 | 0 | 1 | 0 | 1 | 0 | 1 | 0 | 1 | 0 | 1 |
| CONDITION N=NORMAL A=ABNORMAL | N | A | A | N | A | A | A | A | | | A | A | | | A | N |
| DETECTION ABNORMAL CONDITION? | | Y | Y | | Y | Y | Y | Y | | | Y | Y | | | Y | |

WHERE 1 = ON, 0 = OFF

*Fig. 2*

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| STATE 1= INVALID | | | | | | | | | | | | | | | | | 1 | 1 | | | 1 | 1 | | | 1 | 1 | | | 1 | 1 | | |
| CONVECTION HEAT DEMAND | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 |
| CONVECTION HEAT AT LOCATION #1 | 0 | 0 | 0 | 0 | 0 | 0 | 0 | 0 | 1 | 1 | 1 | 1 | 1 | 1 | 1 | 1 | 0 | 0 | 0 | 0 | 0 | 0 | 0 | 0 | 1 | 1 | 1 | 1 | 1 | 1 | 1 | 1 |
| CONVECTION HEAT AT LOCATION #2 | 0 | 0 | 0 | 0 | 1 | 1 | 1 | 1 | 0 | 0 | 0 | 0 | 1 | 1 | 1 | 1 | 0 | 0 | 0 | 0 | 1 | 1 | 1 | 1 | 0 | 0 | 0 | 0 | 1 | 1 | 1 | 1 |
| CONVECTION BLOWER DEMAND | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 |
| CONVECTION BLOWER | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 |
| CONDITION N=NORMAL A=ABNORMAL | N | A | A | N | A | A | A | A | A | A | A | A | A | A | A | A | | | A | A | | | A | A | | | A | A | | | A | N |
| DETECTION ABNORMAL CONDITION? | | Y | Y | | Y | Y | Y | Y | Y | Y | Y | Y | Y | Y | Y | Y | | | Y | Y | | | Y | Y | | | Y | Y | | | Y | |

WHERE 1 = ON, 0 = OFF

*Fig. 3*

MULTIPROBE INTELLIGENT DIAGNOSTIC SYSTEM FOR FOOD-PROCESSING APPARATUS

This invention relates generally to safety diagnostic systems, and more particularly to a multiprobe diagnostic system to be used to identify improper cooking conditions in any cooking appliance that has at least one heating source and other control functions, any combination of which, in the failure mode, would cause the cooking process to degrade into a substandard performance level.

BACKGROUND OF THE INVENTION

Heretofore, computers have been used in controlling and regulating the temperature within cooking appliances to insure that food is cooked and baked to the proper degree of doneness. For example, U.S. Pat. No. 3,326,692 to Martino discloses a method and apparatus for sensing variations in cooking temperature and thereby adjusting the duration of the cooking cycle to achieve the desired degree of doneness. U.S. Pat. No. 4,437,159 to Waugh discloses a cooking computer with a temperature sensing probe for measuring variances from a set temperature point and adjusting the required cooking time accordingly. U.S. Pat. Nos. 4,663,710; 4,672,540; and U.S. Pat. No. 4,858,119 to Waugh disclose cooking appliances utilizing temperature sensitive circuitry connected to control means for cooking food according to preset data.

One problem associated with the use of the heretofore mentioned cooking computers is their inability to detect failures in multi-function and/or multi-zone cooking apparatus, such as combi-ovens or rotisserie ovens. These ovens may contain several different heating elements and serve a variety of functions. The failure of any heating source or control function would cause the oven to operate in a substandard mode. Often these failures are not immediately obvious. For example, when the convection movement element, such as a blower, fails, the temperature of the oven cavity may appear to be correct. However, the air temperature within the oven may vary widely at different locations in the oven. The result is unevenly cooked food being served to customers with the risk of food poisoning and even death. The increased use of such multi-function ovens in commercial settings, particularly fast-food and convenience stores, requires a reliable mechanism for monitoring a plurality of parameters and insuring that food is properly and consistently prepared. Such multi-function control systems have been contemplated in the past. For instance, U.S. Pat. No. 4,782,445 to Pasquini discloses a control apparatus for averaging the temperatures of a plurality of temperature probes as a means for controlling the temperature and steam in a cooking apparatus. U.S. Pat. No. 4,920,948 to Koether relates to a parameter control system for a multi-function combi-oven capable of controlling cooking time, temperature, humidity, and/or air flow by use of several predetermined control algorithms having programmable parameter variables. U.S. Pat. No. 5,197,375 to Rosenbrock discloses further a control device using temperature sensors for a multi-zone conveyer oven.

However, as is increasingly necessary for reliable use in commercial convenience-type operations, the aforementioned control apparatuses are not always capable of adequately detecting temperature differentials which may result from either equipment failures or improper equipment installation/operation and sending corresponding signals to the appliance operator with associated logic reference points to indicate where the failure has occurred.

Consequently, there is a need in the art for a diagnostic system that will provide real-time monitoring and feedback of multi-function ovens by promptly diagnosing equipment failures and sending corresponding output signals. Such a diagnostic system can be used effectively with a cooking computer communication system (for example, the one described in U.S. Pat. No. 4,812,963), and thus effectively transmit output signals provided by the diagnostic system to both local and remote locations and users.

SUMMARY OF THE INVENTION

It is therefore an object of the present invention to promptly diagnose equipment failures in cooking appliances.

Another object of the invention is to establish corresponding output to signal or warn personnel of the detailed location of the equipment failure.

A further object is to abort, cancel, or delay the cooking process upon recognition of equipment failures in a cooking apparatus.

A still further object is to monitor, either continuously or in batch mode, the safe, reliable operation of commercial cooking appliances from a remote location.

Another object of the invention is to control variables such as temperature, humidity, air flow, etc. in the cooking appliance in accordance with the cooking conditions in the appliance set by the user.

These and other objects are realized by a multiprobe diagnostic system for a cooking appliance, for example, an oven, comprising at least one heating element according to the present invention. A temperature sensor, such as a resistance temperature detector, is placed near the heating element so as to effectively monitor the temperature of the heating element. A second temperature sensor is placed away from the heating element so as to measure the temperature of the air within the oven cavity at a distance from the heating element. The cooking appliance is connected to a system controller which houses the electronics for the temperature sensors and runs the computer programs designed to monitor and diagnose failures in the cooking appliance in accordance with the present invention. The system controller also houses other communication and diagnostic systems such as a smart interface board (SIB) and a relay interface board (RIB) in addition to the diagnostic system described in this invention.

The diagnostic system according to the present invention compares the temperatures measured by the temperatures sensors with predetermined or learned minimum and maximum values empirically determined based on any particular set of cooking conditions. These predetermined values are essentially default values for various variables for a particular set of cooking conditions. A typical system may have such predetermined default values programmed into memory as it comes off the shop floor. Alternatively, the system can be programmed to learn or determine its own maximum or minimum values for the various parameters, for any particular set of cooking conditions, when first applied to a new appliance known to be working properly. This is sometimes referred to as "self-tuning" or "self-learning". Thus, a properly operating system could be configured to determine its own maximum and minimum values, and thereby "learn" what the normal range of values for the various parameters are. These "learned" values would then subsequently be compared to measured values during operation of the appliance. This mode is useful since the minimum and maximum values that may be assumed by various parameters may change as the appliance ages or these values may differ based on different operating environments. This self-tuning mode accommodates such changes and allows for the stored values to be changed with time.

The present invention also can compare the temperatures detected by the temperature sensors to calculate a differential. Then, the system may compare the actual temperature differential to a predetermined or learned minimum and maximum temperature differential for that particular cooking element or sensor location(s). These minimum and maximum temperature differentials are empirically predetermined according to a specific set of cooking conditions or they may be self-learned as described above. For example, in cold start conditions, the range of acceptable temperature differentials should be broad enough to compensate for the rapid change in temperature associated with pre-heating a cold oven. Other cooking conditions include transient, steady state, and cooking load (individually tailored to accommodate the cooking of many different types of food) each of which have corresponding minimum and maximum temperature differentials.

If the actual temperature differential is within the range of the predetermined or learned minimum and maximum temperature differentials, the diagnostic system will determine that the cooking appliance is operating properly. However, if the actual temperature does not correspond to the predetermined or learned minimum and maximum temperatures, the system will diagnose where the malfunction has occurred and send the appropriate signal to the operator of the cooking appliance or communicate/transmit the signal to a remote monitoring point or station. These signals can be displayed locally or routed through a computer communication system to a hand-held, remote communicating device as described in U.S. Pat. No. 4,812,963.

In another embodiment, other devices, such as current sensors, can be used in conjunction with temperature sensors to improve the quality and informational content of the diagnostic data. Current sensing (i.e., sampling the current to a subsystem of a cooking appliance, such as a motor) provides additional data that is used to supplement and reinforce the information that is obtained from the temperature sensors. This information about the operating conditions of an appliance, such as the current flow to a subsystem, can be periodically updated in the monitoring computer's memory. This avoids obsolescence in the monitoring system since the monitoring system is maintained up-to-date. In addition, acceptable values for operating conditions, such as acceptable values for current flow to a subsystem, can be stored in the computer's memory, and the instantaneous measured values can be compared to the stored acceptable values to determine normal and abnormal conditions of operation. As subsystems change due to changes in design, supply, and manufacturing, the acceptable values for subsystem operation can be updated so as to accommodate these changes.

A preferred embodiment of the present invention comprises a plurality of heating elements utilizing both convection and radiant heating sources. The radiant heat may be supplied by electric or gas or any other suitable means. However, the present invention is not limited to cooking appliances utilizing both convection and radiant heat sources, as a radiant-only or convection-only appliance will similarly benefit from the use of this diagnostic system. In addition, cooking appliances using infrared or microwave heat sources or using steam generation can also benefit from the use of this diagnostic system. The preferred embodiment further comprises an air convection movement element, such as a convection blower or fan, for circulating air throughout the heating chamber of the cooking appliance.

A preferred embodiment of the present invention also provides for aborting operation of the cooking appliance based on identification of a predetermined error condition.

BRIEF DESCRIPTION OF THE DRAWINGS

FIG. 2 is a table depicting the possible states in a cooking appliance system comprising one heating element and one convection blower;

FIG. 3 is a table depicting the possible states in a cooking appliance system comprising two heating elements and one convection blower;

FIG. 11(*b*) is a continuation of the flow chart shown in FIG. 11(*a*);

FIG. 11(*c*) is an alternative continuation for the flow chart shown in FIG. 11(*a*).

DETAILED DESCRIPTION OF THE PREFERRED EMBODIMENTS

Figure 1:
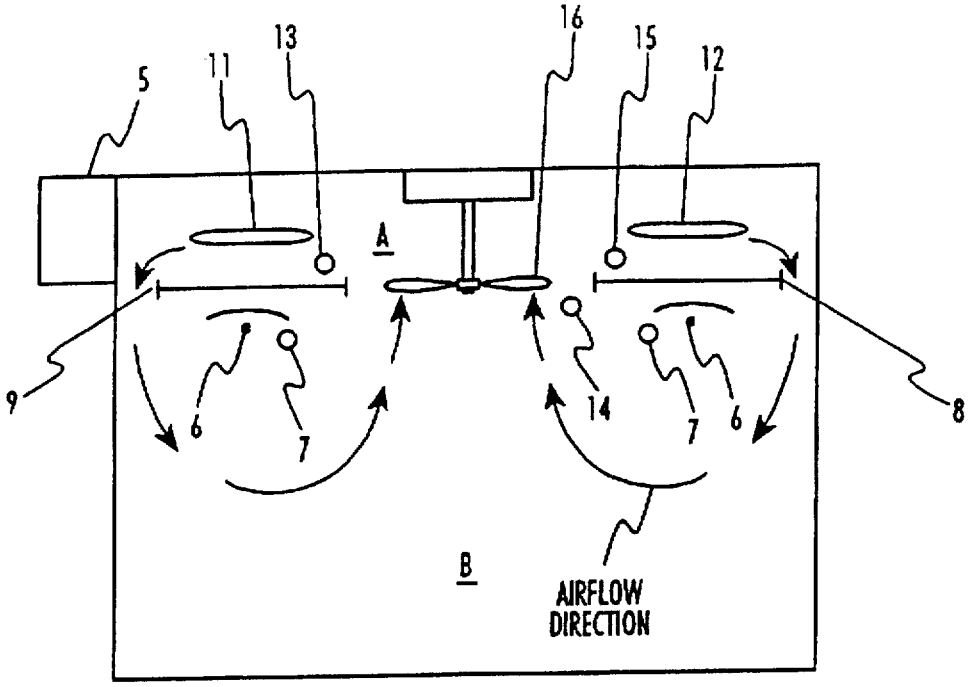
FIG. 1 is a schematic diagram representing a cross-section of a cooking appliance utilizing the multiprobe diagnostic system according to the present invention.

Before referring to the drawings in detail, it will be understood that for purposes of clarity, the apparatus presented in the schematic diagram in FIG. 1 preferably utilizes, for example, an analog to digital converter and a microprocessor which includes such hardware as a central processing unit, program and random access memories, timing and control circuitry, input-output interface devices and other conventional digital subsystems necessary to the operation of the central processing unit and system controller as is well understood by those skilled in the art. Alternatively, the entire control system and peripherals can be completely implemented using analog circuitry, which a person of ordinary skill in the art could readily devise based on the disclosure contained herein. A representative diagnostic program that is run by the system controller in accordance with the methodology outlined in the flow charts is shown in FIGS. 4 through 9. This diagnostic program can be stored in conventional random-access memory or in a pre-programmed chip, such as an EPROM or EEPROM. It is important to note that a person of ordinary skill in the art may create diagnostic programs tailored to suit any particular cooking appliance using the principles outlined in this invention.

An example of a representative cooking appliance for use with the diagnostic system of the present invention is shown schematically in FIG. 1. The exemplary cooking appliance of the present invention includes two or more convection heating elements 11, 12 situated within a convection air passageway (A) to provide convection heat to the oven cavity (B). One or more convection blowers 16, also located within one or more passageways, directs the flow of air therein by pulling or pushing air towards or away from the blower, thereby creating a return air pathway around the blower, and circulating the air down through the supply air pathways 8 and 9, located, for example, in the corners, walls, or sides of the oven cavity. The air flow created by the convection blower 16 and typical air supply pathways 8 and 9 helps to provide uniform distribution of heat throughout the oven cavity. In addition, the air flow is directed to impact the surface of the food item being cooked, thereby interrupting the insulating, boundary layer between the ambient and the cooking surface, thus speeding up the cooking process. In addition to the convection heating elements, gas or electric radiant heating elements 6 can be placed at appropriate locations within the oven cavity of the cooking appliance. The heating elements may be gas or electric, or a combination of both.

A first temperature sensor 13 ($T_{E1}$) is located in proximity to the convection heating element 11 in location #1 so as to measure the temperature at the location of this heating source 11, and thus approximate the temperature of the element. Similarly, a second temperature sensor 15 ($T_{E2}$) is located in proximity to the second convection heating element 12 so as to measure the temperature at location #2, and thus approximate the temperature of the second element. In this example, the first and second sensors serve as an error-detecting means. Preferably, the error-detecting temperature sensors are positioned in proximity to the heating elements such that, while substantially measuring the temperature of elements 11 and 12, they are influenced by the direct heat from the elements and also to a lesser degree by air flow effects. In an example that has achieved satisfactory results, sensors 13 and 15 were located about two inches from their respective heating elements. Such a spacing allows the sensors to sense/indicate air flow irregularities which may cause localized overheating. In practice, actual spacing will depend on the type of sensor used and the overall effect desired. For example, a thermocouple sensor could be placed directly on the heating elements or on a surface adjacent, if air effects are to be measured. In general, spacings of about one-half to about five inches may be used.

A third temperature sensor, 14 ($T_1$) is spaced away from any of the error-detecting temperature sensors and the heating elements so as to measure the temperature of the air as it circulates throughout the oven cavity by operation of the convection blower 16, and is substantially unaffected by direct heat from the heating elements under normal operating conditions. For example, such a temperature sensor may be used to detect a malfunction in a convection blower, such as reversal of the direction of rotation. In general, the relative position and values sensed by the temperature sensors change depending upon the number of convection fans, heating elements and the shape of the ducts or cavities. Depending upon the configuration of the cooking appliance (i.e., the number and kinds of heating elements, presence of a convection blower, etc.), additional temperature sensors may be employed at locations similar to the locations of $T_{E1}$, $T_{E2}$, and $T_1$ to provide additional inputs to the diagnostic system. For example, additional error-detecting temperature sensors 7 may be provided adjacent radiant elements 6 for monitoring their operation. In addition, the temperature values assigned to $T_{E1}$, $T_{E2}$, $T_1$ and the like by the diagnostic system may be an average of temperatures measured by a plurality of temperature sensors appropriately placed in the appliance such as disclosed in U.S. Pat. No. 4,782,445 which is incorporated herein by reference thereto.

The temperature sensors are typically commercially available resistance temperature detectors, thermistors, or thermocouples. The choice of temperature sensor typically depends upon the range of temperatures to be measured using the particular temperature sensor. For example, thermistors are most suitable for measuring the lowest temperatures and thermocouples are used for the highest temperatures encountered in a cooking appliance. In a preferred embodiment, resistance temperature detectors are employed. The electronics for the temperature sensors reside in the system controller 5 which runs the diagnostic system of the present invention and may also manage a number of other diagnostic and control functions such as disclosed in U.S. Pat. No. 4,812,963 which is incorporated herein by reference thereto. The system controller 5 is typically a microprocessor-based test box having an light-emitting diode (LED) or vacuum fluorescent device (VFD) display and $E^2$PROM memory and RAM.

Upon receiving the temperature data gathered by the temperature sensors 13, 14, and 15, the system controller 5 automatically runs through the diagnostic system methodology of the present invention, as outlined in the flow charts shown in FIGS. 4 through 9. By constantly monitoring the temperature at the sensors, calculating actual measured temperature differentials and comparing the measured differentials with predetermined or learned maximum and minimum values, the diagnostic program determines whether all the elements in the cooking appliance, e.g., the convection blower, radiant or convection heating elements etc., are functioning in accordance to the demands placed on them by the system controller. Monitoring the temperatures as described in the present invention is particularly important since other diagnostic systems in the system controller such as the smart interface board (SIB) or relay interface board (RIB) may be limited in their diagnostic and error-detecting capabilities. For example, the motor checker or resistance checker in the SIB monitors the shaft connected to a convection movement element, such as a fan blower, to ensure that it is turning but will be unable to detect a loose fan wheel, or a blade that is not turning or perhaps turning in the opposite direction. Improper operation of the blades as manifested in a variation in temperature in the cooking appliance would, however, be detected by the diagnostic system described by the present invention. The demands placed on the appliance elements are in accordance with the cooking conditions/recipes set by the user. If the diagnostic program determines that any of the elements in the cooking appliance are not operating in accordance with the demands placed on them, it sets different error conditions in an error-recording data structure in memory. The output display control software routine interrogates the error-recording data structure and displays an output to the user which pinpoints both the malfunctioning unit and the problem associated with it. The diagnostic system methodology of this invention is further described by reference to two exemplary systems.

In one example, involving a cooking appliance consisting of one convection heater and one convection blower, the diagnostic system of the present invention will detect one of 16 possible states in the cooking appliance based upon the inputs from the temperature sensors. These states, which are recorded in an error-recording data structure in memory, are summarized in FIG. 2. Of the 16 possible states, 4 are invalid, 3 are normal and 9 are abnormal. An invalid state results, for example, when convection heat is demanded without simultaneous demand of convection blower. Preferred embodiments of the present invention allow for no such configuration since it is anticipated that the convection heat will only be operating with the use of the blower. In preferred embodiments, a normal state occurs in three instances: when there is neither heat demand nor blower demand and neither the heat nor the blower elements are operating; when there is no heat demand but there is blower demand and the blower is operating properly; or, when there exists both heat demand and blower demand and both elements are operating properly. When any one of these normal states is detected, the appliance is running properly and no error signal will be displayed. The remaining states set forth in FIG. 2 are considered abnormal. An abnormal state is indicative of a failure in one of the control elements of the cooking appliance and results in the display of the appropriate error signal. As explained below, the diagnostic program identifies which particular abnormal state has been detected, thereby pinpointing the location of the failure in the system.

FIG. 3 is a table summarizing the possible states occurring in a typical cooking appliance comprising two heating elements and one convection blower. All the possible states in the cooking appliance are recorded in an error-recording data structure in memory. Of the 32 possible states, states 17, 18, 21, 22, 25, 26, 29 and 30 are shown to be invalid because convection heat is demanded without simultaneous demand of convection blower. States 1, 4, and 32 are normal states whereby the appliance is running properly and no error signal will be displayed. The normal states occur in the same three instances as described above for the simpler system: when there is neither heat demand nor blower demand and no heat or blower elements are operating; when there is no heat demand but there is blower demand and the blower is operating properly; and, when there is both heat demand and blower demand and the blower and both heating elements are operating properly. The remaining states set forth in FIG. 3 are considered abnormal and result in the appropriate error signal being generated.

The abnormal states for this embodiment, as set forth in FIG. 3, are as follows:

- states 2, 6, 10, and 14 are abnormal because the blower is operating with no corresponding blower demand;
- states 3, 7, 11, 15, 19, 23, 27, and 31 are abnormal because the convection blower is not operating according to its demand;
- states 5 through 16 are abnormal because there is no heat demand and either one or both of the convection heating elements is in operation; and
- states 19, 20, 23, 24, 27, and 28 are abnormal because one or both of the convection heating elements are not operating according to demand.

Depending on the particular needs and demands placed on the cooking system, a person skilled in the art may alter the normal/abnormal conditions as required for a particular application. Therefore, a person skilled in the art may appropriately modify this algorithm and use sensors effectively to fit oven designs other than the described preferred embodiment.

Figure 4:
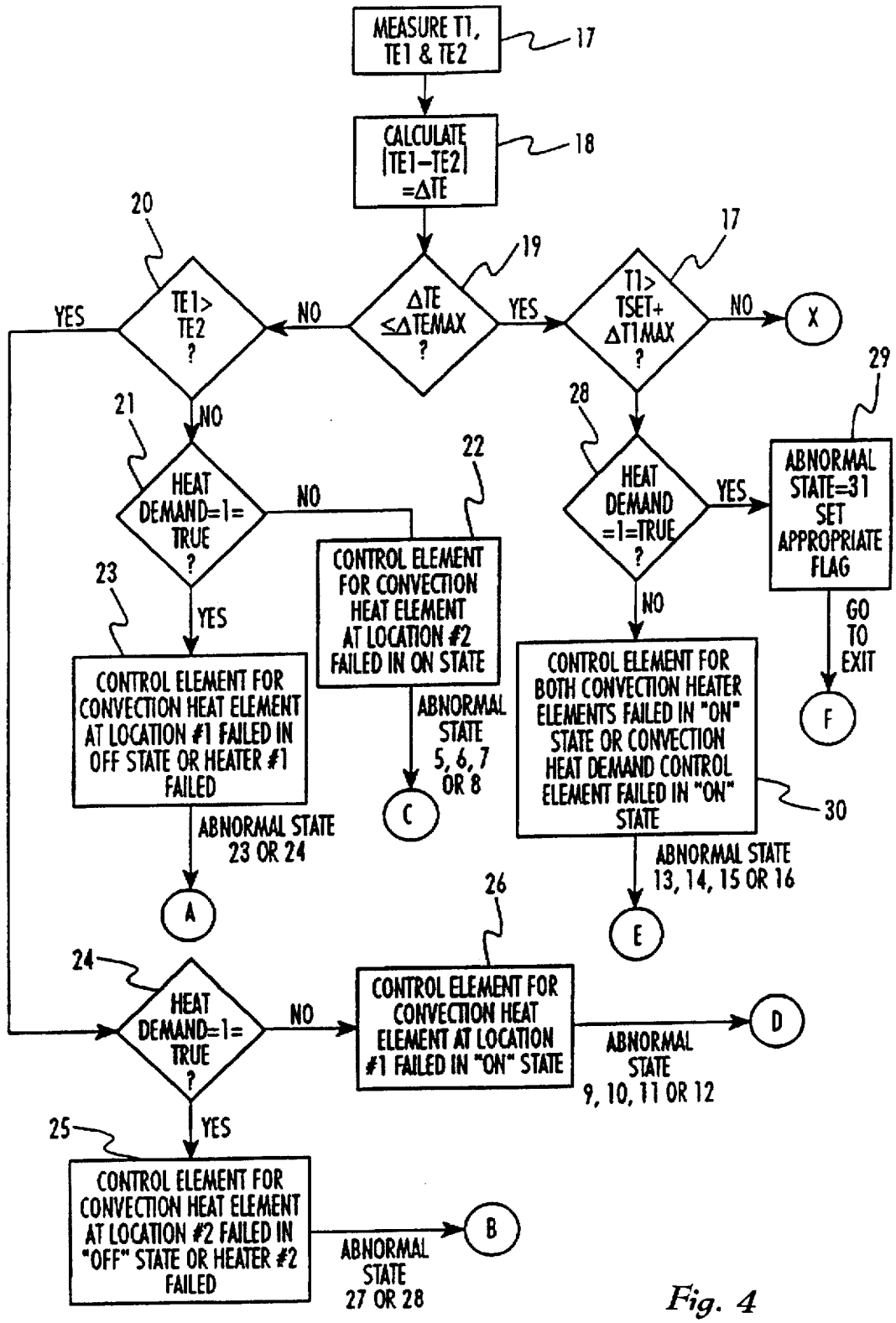
FIGS. 4 and 5 are flow charts representing the main loop of the computer program utilized in the present invention.

FIG. 4 depicts the main loop of a typical computer program utilized in the present invention to monitor cooking conditions in a representative cooking appliance system shown in FIG. 1. This computer program is run by the system controller using the temperature data obtained by the temperature sensors. The first step of the program is to "measure $T_1$, $T_{E1}$ and $T_{E2}$," as shown in block 17, where $T_1$ is the temperature measured by the control temperature sensing means, $T_{E1}$ is the temperature measured by the error-detecting temperature sensing means located in proximity to the convection heating element at location #1, and $T_{E2}$ is the temperature measured by the error-detecting temperature sensing means located in proximity to the convection heating element at location #2. The next step is to "calculate $\Delta T_E$, " as shown in block 18, where $\Delta T_E$ is equal to the absolute value (therefore, sign insensitive) of the difference between $T_{E1}$ and $T_{E2}$ as expressed by the mathematical formula: $\Delta T_E=|T_{E1}-T_{E2}|$. The next step is a decision block 19 comparing $\Delta T_E$ to $\Delta T_{EMAX}$, where $\Delta T_E$ is computed as described above in block 18 and $\Delta T_{EMAX}$ is the predetermined or learned maximum differential in temperature as measured by $T_{E1}$ and $T_{E2}$. This predetermined or learned maximum is empirically determined based on a specific set of cooking conditions in the appliance at that time and, therefore, varies according to the prescribed circumstances. When $\Delta T_E$ is greater than $T_{EMAX}$, the next step is to compare $T_{E1}$ to $T_{E2}$ as shown in decision block 20. If $T_{E1}$ is not greater than $T_{E2}$, the program proceeds to decision block 21 to determine whether "heat demand=1=true?" If the heat demand is 0 (i.e., false), the program proceeds to a "control element for convection heat element at location #2 failed in 'on' state" block 22 which is coupled to a "convection blower demand=1=true?" decision block 46 of FIG. 6.

Figure 5:
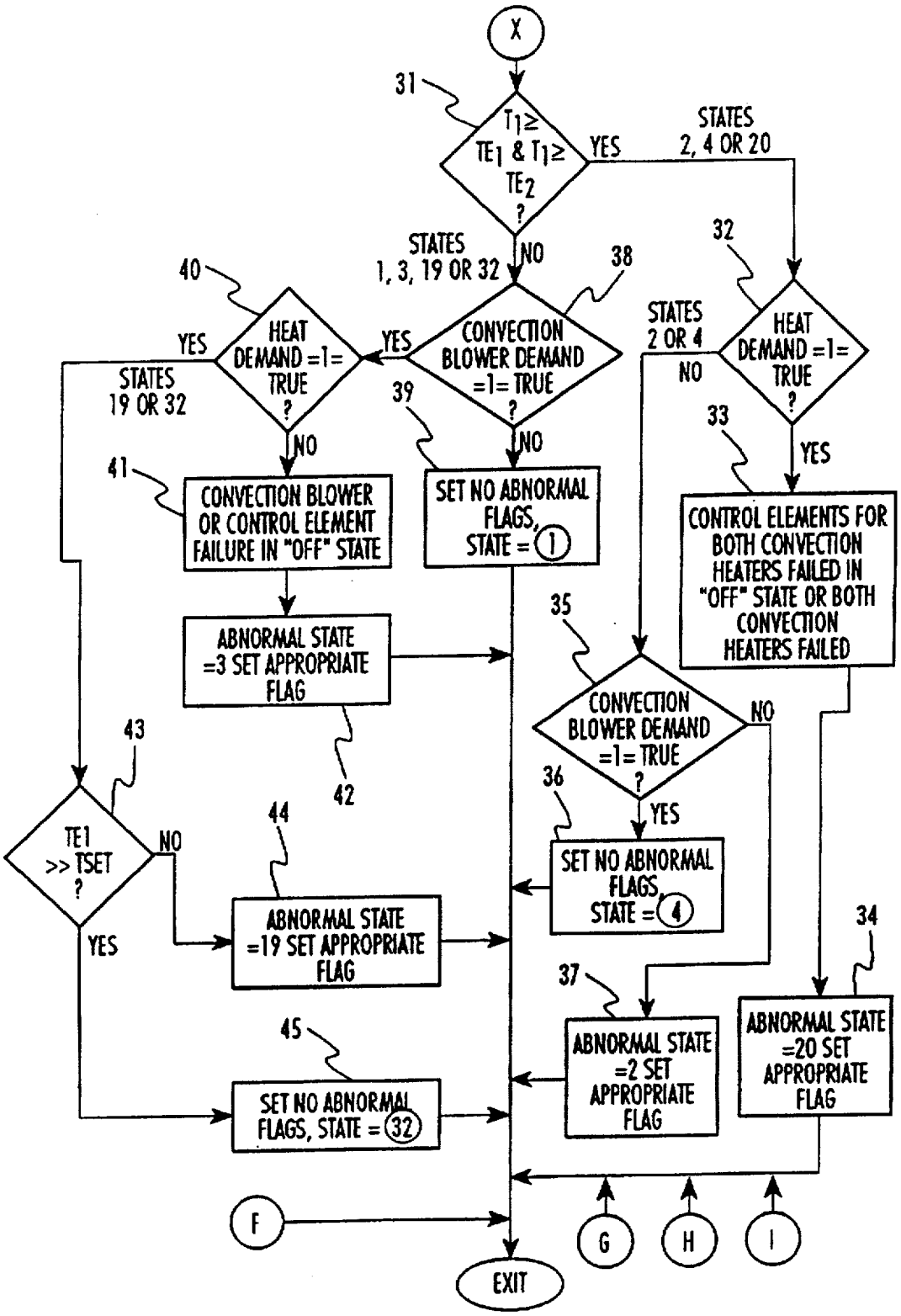
Figure 6:
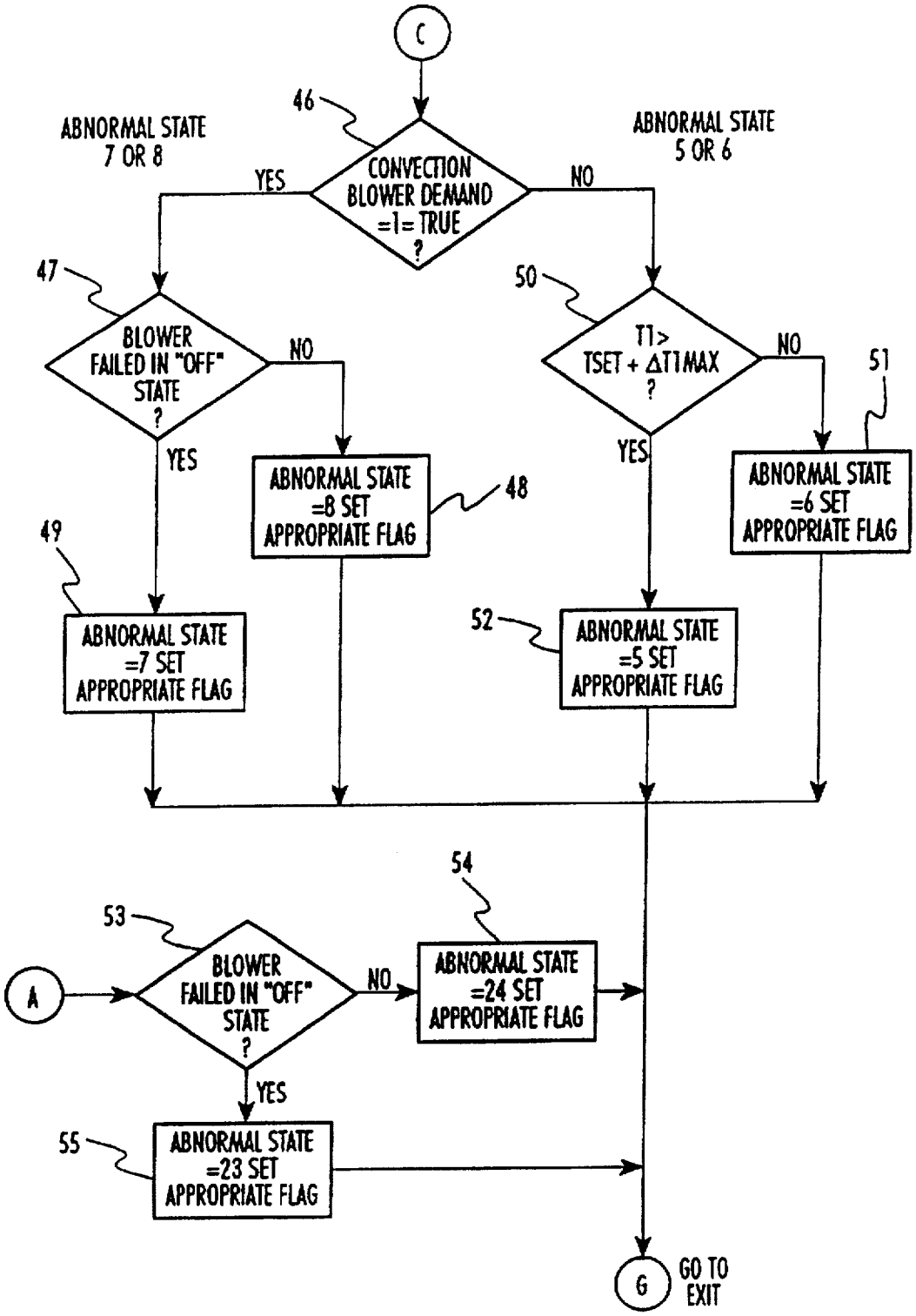
FIG. 6 is a flow chart for the error identification subroutine for identification of a set of abnormal states.

The subroutine in FIG. 6, therefore, determines which of four possible abnormal states (5, 6, 7 or 8) exists in the system when exiting from block 22. If the convection blower demand is true in block 46, the next step is to determine whether the "blower failed in 'off' state?", as shown in decision block 47. Means for determining whether the convection blower failed in 'off' state are represented by the flow chart shown in FIG. 9 whereby if $T_1$ is greater than $T_{SET}+\Delta T_{1MAX}$, where $T_{SET}$ is the temperature at which the cooking appliance has been set and $\Delta T_{1MAX}$ is the predetermined or learned maximum change in temperature allowed in $T_1$ for the particular set of cooking conditions found in the appliance, it is determined that the blower failed in 'off' state; otherwise, the blower is determined to be functioning properly. Returning to FIG. 6, if the blower failed in 'off' state, the program proceeds to "abnormal state=7, set appropriate flag" block 49 whereby the corresponding output signal is created to indicate abnormal state 7, returning then to the main loop at location G of FIG. 5 at which point the program is exited. If the blower has not failed in 'off' state, the next step is an "abnormal state=8, set appropriate flag" block 48 whereby the corresponding output signal is created to indicate abnormal state 8, and the program returns to the main loop at location G of FIG. 5, at which point the microcomputer program is exited.

If there is no convection blower demand in block 46, the next step is a "$T_1>T_{SET}+\Delta T_{1MAX}$?" decision block 50. If $T_1$ is greater than $T_{SET}+\Delta T_{1MAX}$, the program proceeds to "abnormal state=5, set appropriate flag" block 52 whereby the corresponding output signal is created to indicate abnormal state 5 and then returns to the main loop at location G of FIG. 5 whereby the program is exited. If $T_1$ is not greater than $T_{SET}+\Delta T_{1MAX}$ in block 50, the program proceeds to an "abnormal state=6, set appropriate flag" block 51 whereby the corresponding output signal is created to indicate the abnormal state 6 and then returns to the main loop at location G of FIG. 5 whereby the program is exited.

Returning to FIG. 4, if the heat demand is 1 in block 21, the next step indicates that a "control element for convection heat element at location #1 failed in 'off' state or heater #1 failed" as shown in block 23 which then couples to "blower failed in 'off' state?" decision block 53 of FIG. 6. If the blower failed in 'off' state, the program proceeds to an "abnormal state=23, set appropriate flag" block 55 whereby the corresponding output signal is created indicating abnormal state 23, and returns to the main loop at location G of FIG. 5 whereby the program is exited. Alternatively, if the blower did not fail in 'off' state, the program proceeds to an "abnormal state=24, set appropriate flag" block 54 whereby the corresponding output signal is created to indicate abnormal state 24 and returns to the main loop at location G of FIG. 5 whereby the program is exited.

Returning to FIG. 4, if $T_{E1}$ is greater than $T_{E2}$ in block 20, the next step is a "heat demand=1=true?" decision block 24. When heat demand is true, the program proceeds to "control element for convection heat element at location #1 failed in 'off' state or heater #2 failed" block 25 which is coupled to a "blower failed in 'off' state?" decision block 63 of FIG. 7. If the blower failed in 'off' state, the program proceeds to a "abnormal state=27, set appropriate flag" block 65 whereby the corresponding output signal is created to indicate abnormal state 27 and returns to the main loop at location H whereby the program is exited. Alternatively, if the blower did not fail in 'off' state, the program proceeds to an "abnormal state=28, set appropriate flag" block 64 whereby the corresponding output signal is created to indicate abnormal state 28 and returns to the main loop at location H whereby the program is exited.

Figure 7:
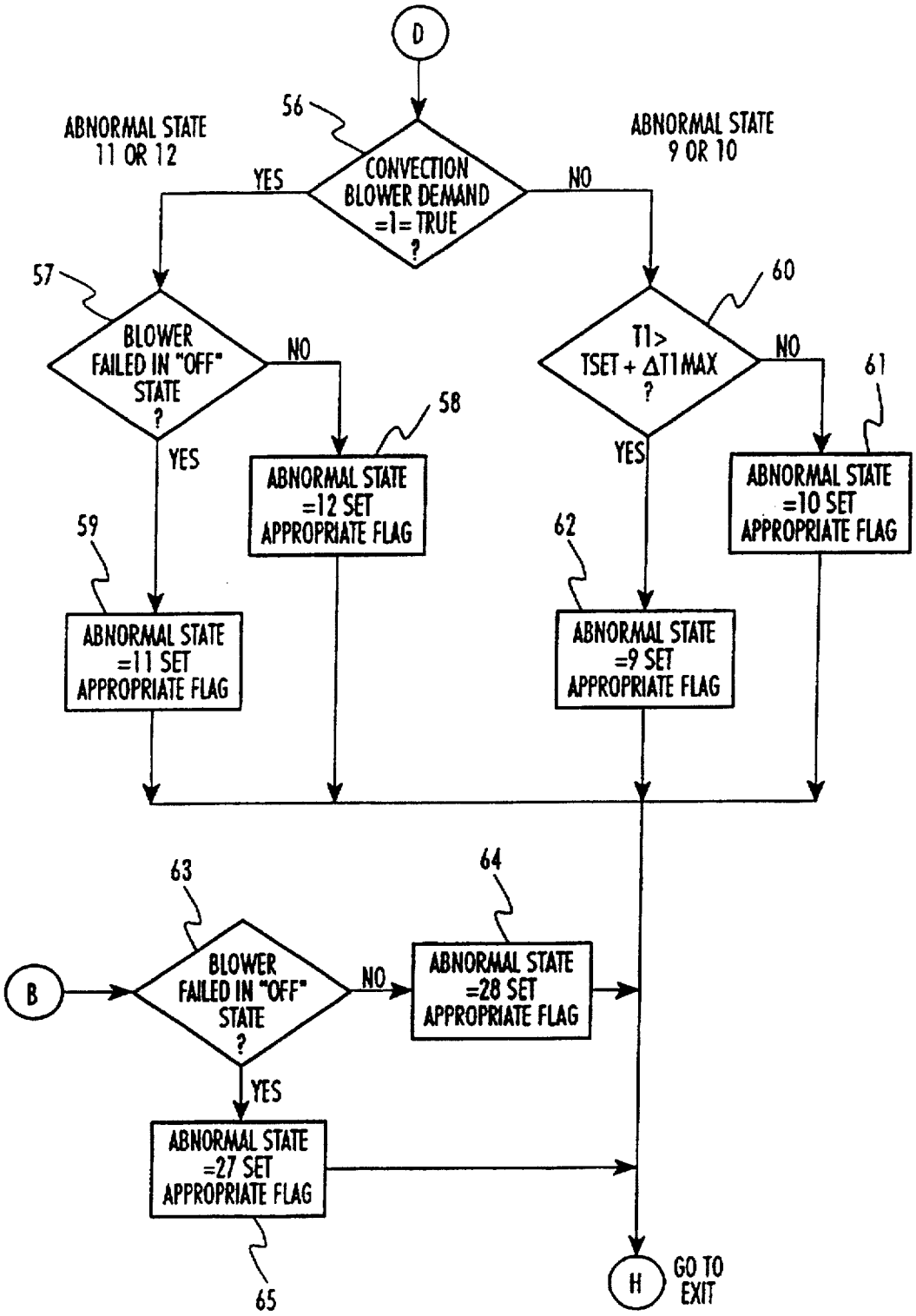
FIG. 7 is a flow chart for the error identification subroutine for identification of a further set of abnormal states.

Returning to FIG. 4, when there is no heat demand in block 24, the next step is a "control element for convection heat element at location #1 failed in 'on' state" block 26 which is coupled to a "convection blower demand=1=true?" decision block 56 of FIG. 7. If the convection blower demand is true, the next step is a "blower failed in 'off' state?" decision block 57. If the blower failed in 'off' state, the program proceeds to an "abnormal state=11, set appropriate flag" block 59 whereby the corresponding output signal is created to indicate abnormal state 11 and then returns to the main loop at location H of FIG. 5 whereby the program is exited. When the blower has not failed, the program proceeds to a "abnormal state=12, set appropriate flag" block 58 whereby the corresponding output signal is created to indicate abnormal state 12 and then returns to the main loop at location H of FIG. 5 whereby the program is exited.

If there is no convection blower demand in block 56, the next step is a "$T_1>T_{SET}+\Delta T_{1MAX}$?" decision block 60. If $T_1$ is greater than $T_{SET}+\Delta T_{1MAX}$, the program proceeds to an "abnormal state=9, set appropriate flag" block 62 whereby the corresponding output signal is created to indicate abnormal state 9 and then returns to the main loop at location H of FIG. 5 whereby the program is exited. If $T_l$ is not greater than $T_{SET}+T_{1MAX}$, the program proceeds to an "abnormal state=10, set appropriate flag" block 61 whereby the corresponding output signal is created to indicate abnormal state 10 and then returns to the main loop at location H of FIG. 5 whereby the program is exited.

Returning to FIG. 4, when $\Delta T_E$ is less than or equal to $\Delta T_{EMAX}$ in block 19, the next step is a "$T_1>T_{SET}+\Delta T_{1MAX}$?" decision block 27. When $T_1$ is greater than $T_{SET}+\Delta T_{1MAX}$, the next step is a "heat demand=1=true?" decision block 28. When heat demand is true, the program proceeds to an "abnormal state=31, set appropriate flag" block 29 whereby the corresponding output signal is created to indicate abnormal state 31 and the program is exited. When there is no heat demand, the next step is a "control element for both convection heater elements failed in 'on' state or convection heat demand control element failed in 'on' state" block 30 which is coupled to a "convection blower demand=1=true?" decision block 66 of FIG. 8. If the convection blower demand is true, the next step is a "blower failed in 'off' state?" decision block 67. If the blower failed in 'off' state, the program proceeds to a "abnormal state=15, set appropriate flag" block 69 whereby the corresponding output signal is created to indicate abnormal state 15, and returns to the main loop at location I of FIG. 5 whereby the program is exited. If the blower is functioning properly, the program proceeds to a "abnormal state=16, set appropriate flag" block 68 whereby the corresponding output signal is created to indicate abnormal state 16 and then returns to the main loop at location I of FIG. 5 whereby the program is exited. If there is no convection blower demand in block 66, the next step is a "$T_1>T_{SET}+\Delta T_{1MAX}$?" decision block 70. If $T_1$ is greater than $T_{SET}+T_{1MAX}$, the program proceeds to a "abnormal state=13, set appropriate flag" block 72 whereby the corresponding output signal is created to indicate the abnormal state 13 and then returns to the main loop at location I of FIG. 5 whereby the program is exited. If $T_1$ is not greater than $T_{SET}+T_{1MAX}$, the program proceeds to a "abnormal state=14, set appropriate flag" block 71 whereby the corresponding output signal is created to indicate abnormal state 14 and then returns to the main loop at location I of FIG. 5 whereby the program is exited.

Returning to FIG. 4, if $T_1$ is not greater than $T_{SET}+\Delta T_{1MAX}$ in block 27, the next step is a "$T_1 \geqq T_{E1}$ & $T_1 \geqq T_{E2}$?" decision block 31 of FIG. 5. If the answer to decision block 31 is yes, the next step is a "heat demand=1=true?" decision block 32. When heat demand is true, the program proceeds to a "control elements for both convection heaters failed in 'off' state or both convection heaters failed" block 33 which is coupled to a "abnormal state=20, set appropriate flag" block 34 whereby the corresponding output signal is created to indicate abnormal state 20 and whereby the program is exited. When there is no heat demand, the next step is a "convection blower demand=1=true?" decision block 35. When blower demand is true, the program proceeds to a "set no abnormal flags, state=4" block 36 whereby no error signal is created and the program is exited. When there is no blower demand, the program proceeds to a "abnormal state=2, set appropriate flag" block 37 whereby the corresponding output signal is created to indicate abnormal state 2 and the program is exited.

When $T_1$ is less than either $T_{E1}$ or $T_{E2}$ in block 31, the next step is a "convection blower demand =1=true?" decision block 38. When there is no blower demand, the program proceeds to a "set no abnormal flags, state=1" block 39 whereby no error signal is created and the program is exited.

When the blower demand is true, the next step is a "heat demand=1=true?" decision block 40. When there is no heat demand, the program proceeds to a "convection blower or control element failure in 'off' state" block 41 which is coupled to a "abnormal state=3, set appropriate flag" block 42 whereby the corresponding output signal is created to indicate abnormal state 3 and the program is exited. When heat demand is true, the next step is a "$T_{E1}>>T_{SET}$?" decision block 43. If $T_{E1}$ is not much greater than $T_{SET}$, the program proceeds to a "abnormal state=19, set appropriate flag" block 44 whereby the corresponding output signal is created to indicate abnormal state 19 and the program is exited. If $T_{E1}$ is much greater than $T_{SET}$ in block 43, the program proceeds to a "set no abnormal flags, state=32" block 45 whereby no error signal is created and the program is exited.

Figure 8:
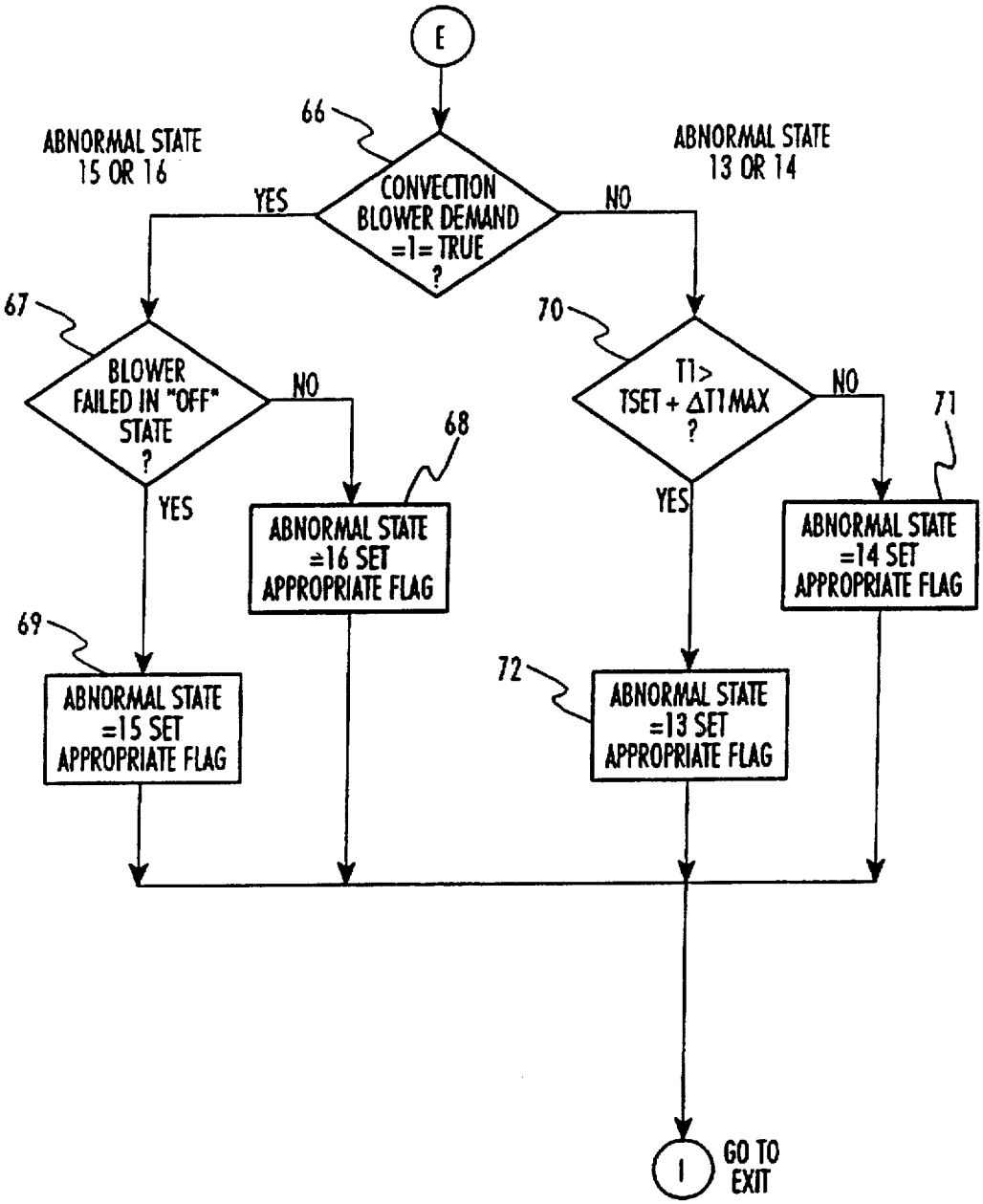
FIG. 8 is a flow chart for the error identification subroutine for identification of other abnormal states.
Figure 9:
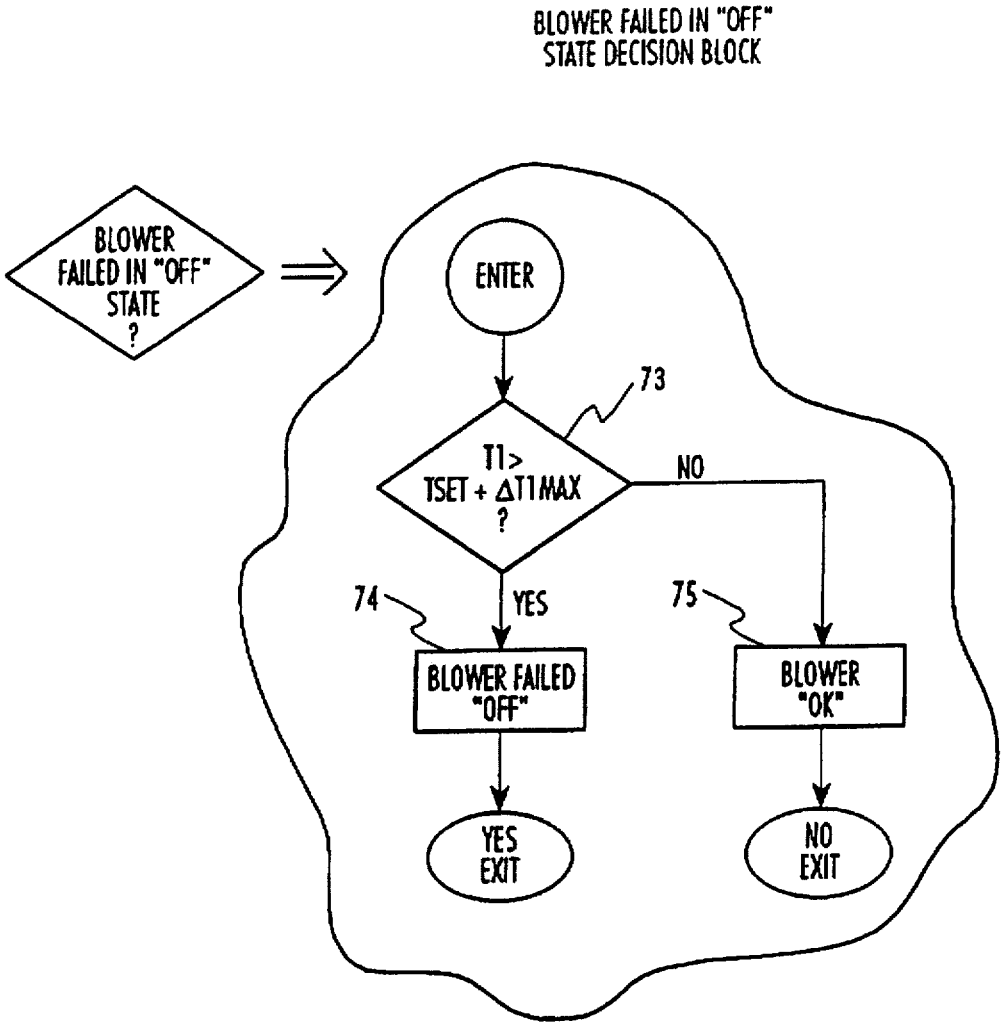
FIG. 9 is a flow chart for the subroutine to determine whether the blower failed in the off state.

The "blower failed in the 'off' state" decision block is found repeatedly throughout the diagnostic routine described in FIGS. 6 through 8 in blocks 47, 53, 57, 63, and 67. This decision block essentially involves the loop shown in FIG. 9. If it is determined in block 73 that $T_1$ is greater $T_{SET}+\Delta T_{1MAX}$ the blower has failed as shown in block 74 or if $T_1$ is less or equal to $T_{SET}+\Delta T_{1MAX}$ the blower is found to be functioning properly as shown in block 75.

In another embodiment, other devices, such as current sensors, are used in conjunction with temperature sensors to augment the information obtained from the temperature sensors. For example, current sensing (i.e., sampling the current to a subsystem of a cooking appliance, such as a motor) provides additional data that is used to supplement and reinforce the information that is obtained from the temperature sensors. This information about the operating conditions of an appliance, such as the current flow to a subsystem, can be periodically updated in the monitoring computer's memory. This avoids obsolescence in the monitoring system since the monitoring system is maintained up-to-date. In addition, acceptable values for operating conditions, such as acceptable values for current flow to a subsystem, can be stored in the computer's memory, and the instantaneous measured values can be compared to the stored acceptable values to determine normal and abnormal conditions of operation. As subsystems change due to changes in design, supply, and manufacturing, the acceptable values for subsystem operation can be updated so as to accommodate these changes.

A portable computer can be used to: (a) input new operating baselines which have previously been preprogrammed into the portable computer; (b) to exercise the appliance in a variety of different operating modes; (c) to sample the current temperature values at a particular point in time in the operating cycle; and (d) at the completion of the testing, to download these new baselines into the memory of the monitoring computer.

Figure 10:
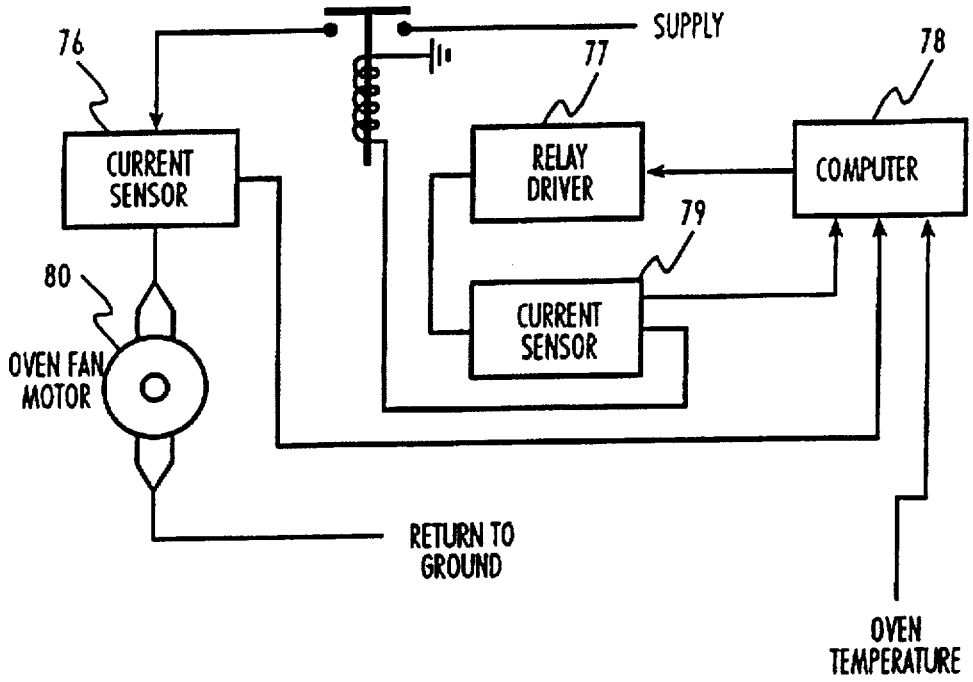
FIG. 10 is a schematic diagram of an oven fan motor utilizing a current sensing fault diagnostic system.
Figure 11A:
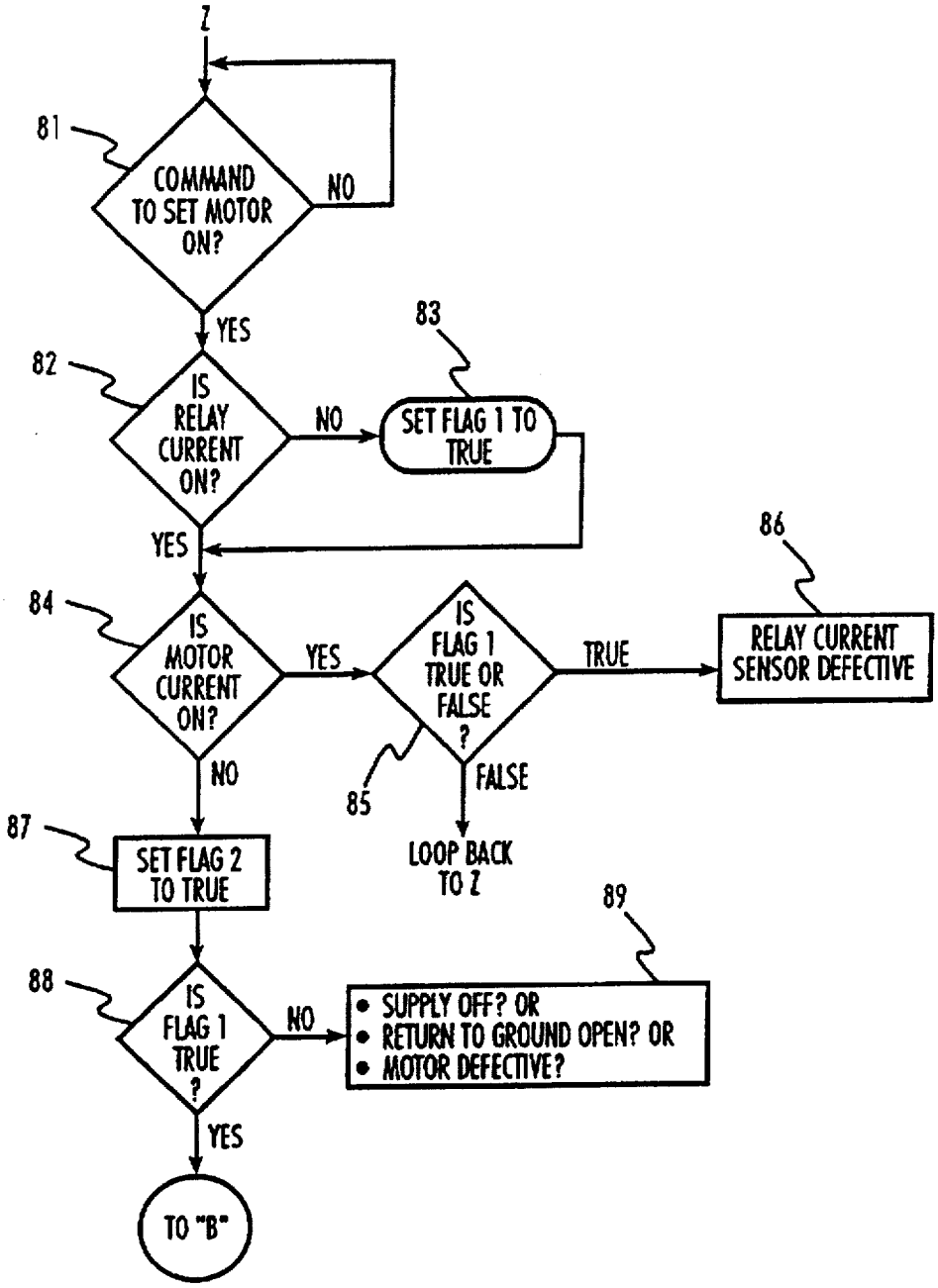
FIG. 11(*a*) is a flow chart for an error identification routine for the subsystem shown in FIG. 10.

For example, FIG. 10 shows a schematic diagram of an oven fan motor utilizing a current sensing diagnostic system to detect malfunctions in the oven fan motor. When the computer 78 containing the control diagnostic software receives a signal to turn the oven fan motor 80 on, it turns the relay driver 77 on, which then pulls in the supply to the oven fan motor 80. FIG. 11 is a representative flow chart for an error identification routine which pinpoints where a malfunction in the subsystem shown in FIG. 10 might be occurring. As seen in FIG.11(*a*), if a command 81 is sent to turn the oven fan motor on, and the current to the relay driver is not on, then flag 1 is set to true. Now if the current to the motor 84 is on, then that indicates that there is a defect in the relay current sensor 79. On the other hand, if the relay current is on in 82 (i.e., flag 1 not set to true in 83) and the motor current is not on (i.e., flag 2 in 87 is set to true) then that points to a malfunction in either the supply to the motor, or the return to ground line of the motor or the motor itself might be defective. It is also likely that more than one possibility outlined in 89 might be malfunctioning. If neither the motor current nor the relay current is on, then the relay driver might be defective 90. Once the diagnostic routine has narrowed down the possibility of the malfunctioning to a couple of choices, the error can be quickly rectified in the field by simply replacing the defective part(s).

Figure 11B:
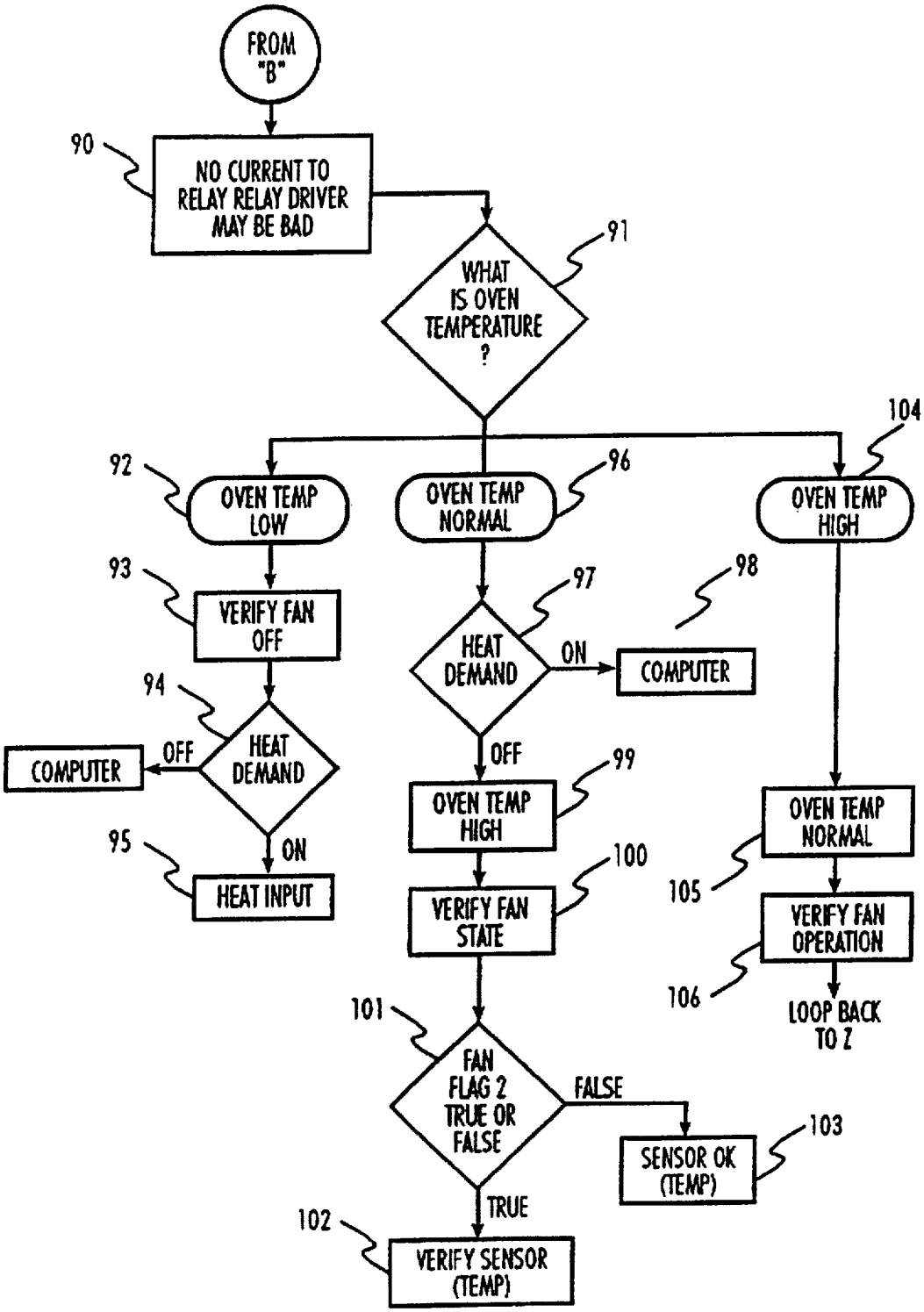
Figure 11C:
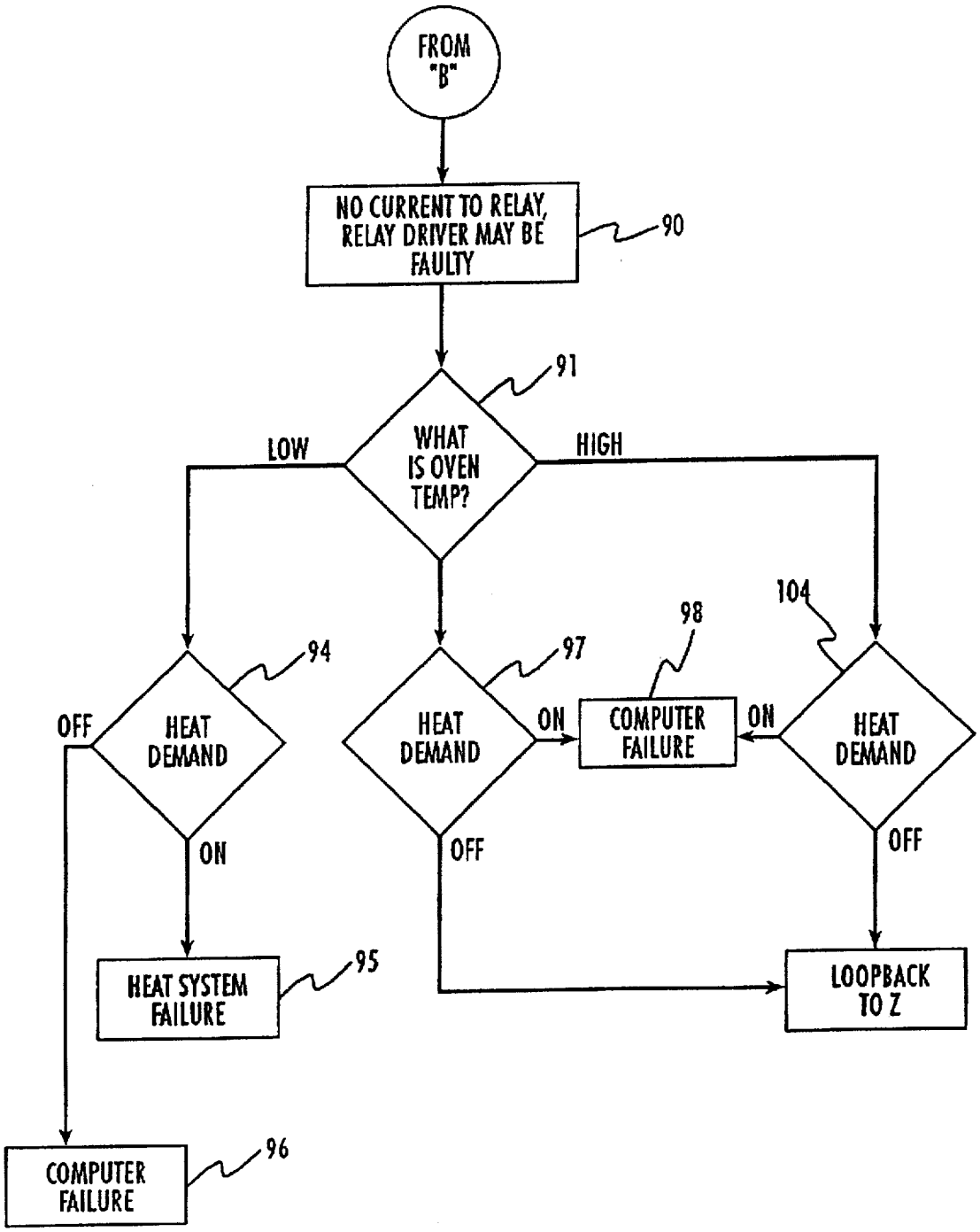

In addition, the oven temperature is monitored by the computer 78 and as seen in FIGS. 11(*b*) and (*c*) depending on whether the oven temperature is low, normal or high, appropriate actions can be taken to ensure that the oven temperature is either returned to or maintained at its user-specified, normal operating temperature. FIGS 11(b) and (c) show two options for how oven temperature control can be achieved in the error identification routine of FIG. 11(*a*). These current sensors may be used for diagnostic purposes with other subsystems in the cooking appliance, such as radiation or convection heaters, rotisserie motors, relays, lamps, door switches, or power switches and the like. Diagnostic routines utilizing these current sensors similar to that shown in FIG. 11 can be written to appropriately identify malfunctions in these other subsystems as well.

These current sensors (for example, the current sensing transformers sold by Coilcraft, Inc.) operate in the analog mode and permit reading of the actual current flow through a subsystem. This permits continuous monitoring and recording of the current values. Therefore, long-term trends and variations in current to a particular subsystem can be tracked effectively and this in turn results in more definitive root cause diagnostics.

Figure 12:
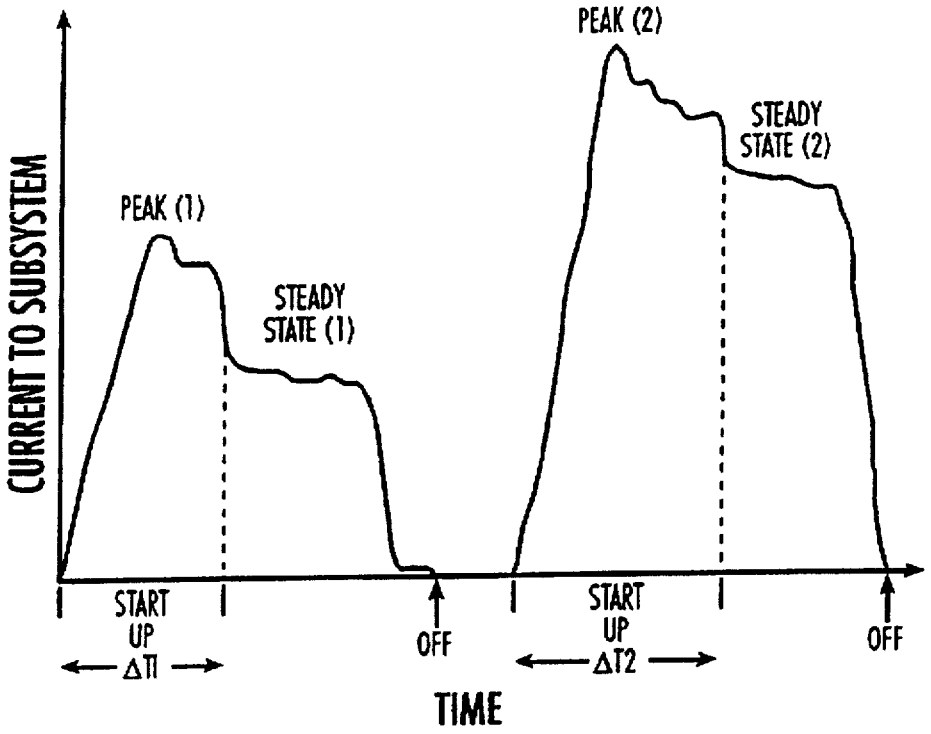
FIG. 12 is a representative plot of the current to a subsystem, such as a oven fan motor, as a function of time, over a period of operation.
Figure 13:
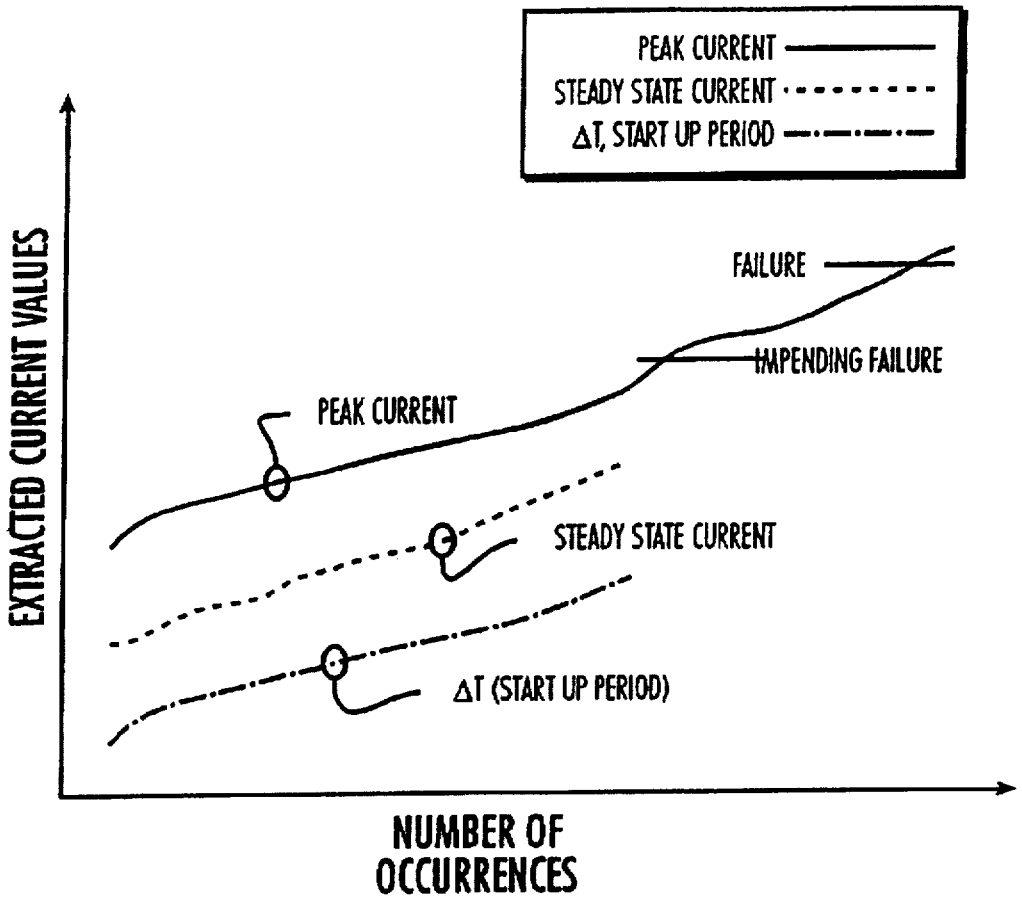
FIG. 13 is a plot of the extracted current values in FIG. 12, and these current values are monitored with repeated operation of the appliance.

For example, FIG. 12 shows the current to a fan motor and the motor current exhibits an initial transient when it is turned and then reaches a steady state value. Note that greater current might be drawn by the motor when the cooking load is greater. If the cooking load is greater at time(2) than at time(1), then current peak(2) and steady state current(2) in FIG. 12 is greater than current peak(1) and steady state current(1). The diagnostic program can be designed to compensate for load variations by normalizing the value of the current to a particular subsystem to the cooking load. FIG. 13 shows how the information collected by the current sensors (e.g., the peak current, the steady state current, and the transient start-up period) can be monitored over a period of time. As the appliance is operated over a period of time, if the current values to a particular subsystem, such as a fan motor (see FIG. 13), increase beyond a known predetermined value of current then impending failures in the subsystem can be predicted and promptly rectified.

As seen in FIGS. 12 and 13, the use of current sensors for the detection of anomalies in the subsystems of a cooking appliance consists of sampling the current to a subsystem, such as a heating element or motor, and comparing these measured values with stored acceptable values. This approach yields more information than simply detecting the presence/absence of current flow to a subsystem in the appliance. The ability to generate and store baselines provides the advantage that both normal and abnormal operating conditions of the subsystem can be characterized and stored. This presents the monitoring and control system with a far-ranging repertoire of fault identification and enhances the opportunity for precise and definitive root cause diagnostics and failure detection. As illustrated in FIGS. 10–13, by using current sensing it is possible to narrow the source of a defect down to a particular part or unit of the system, which can then be replaced by a service engineer in the field.

The use of current sensors in conjunction with temperature sensors allows the opportunity for determining when the appliance is functioning in an "as built" condition and to determine if non-standard parts have been used in the appliance. It will be possible to obtain an as built "birth certificate" of the appliance either when it is shipped from the factory or when it has been first installed in the restaurant. In this way, subsequent repairs can be referenced to the birth certificate. Using this computerized system before the repair process is begun permits the service person to stock the most likely spares and obtain the service history before leaving for the job site, thus saving valuable service time. While at the job site the computer will aid the repair process as it will guide the service person through the fault tree outlining the most productive repair areas. After repair, the computer can update the baselines and log the time and material necessary for the repair.

The above process will be made more reliable by the use of temperature sensing and current sensing since a more definite cause for the malfunction is possible with the system which has more sources of information for the fault logic to operate on.

While the diagnostic system of this invention has been described in the context of a cooking appliance with convection heating elements with convection blowers, the underlying principles of this invention can be utilized to construct similar diagnostic routines for cooking appliance systems with both radiant and convection heating elements or with radiant heating elements only as the desired application warrants. In addition, this invention can also be utilized to construct similar diagnostic routines for cooking appliance systems with infrared or microwave heating elements or with heating elements that generate steam.

Therefore, while there have been described what is at present considered to be the preferred embodiments of this invention, it will be obvious to those skilled in the art that various changes and modifications may be made without departing from the invention, and it is, therefore, aimed to cover all such changes and modifications that fall within the true spirit and scope of the invention.

What is claimed is:

1. A multiprobe diagnostic system for a cooking appliance including at least one heating element comprising:

at least one error-detecting temperature sensor to measure temperature at said heating element;

at least one control temperature sensor to measure ambient temperature within said appliance at location spaced away from said at least one heating element;

means for comparing temperature measured by any of said sensors to predetermined or learned minimum and maximum values for said temperature at the respective sensor and providing a first signal based thereon;

means for calculating temperature difference between two temperature sensors at two different locations and for comparing said difference to predetermined or learned minimum and maximum values for said difference in temperature between the respective sensors and providing a second signal based thereon; and means for identifying and setting error conditions in response to said first and second signals.

2. The diagnostic system according to claim 1, for use with an appliance having at least two heating elements, wherein:

said at least one error-detecting temperature sensor comprises a first sensor to measure temperature at a location in proximity to a first heating element and a second temperature sensor to measure temperature at a location in proximity to a second heating element; and said calculating means comprises means for calculating temperature difference between said first and second error-detecting sensors and generating said second signals based thereon.

3. The diagnostic system according to claim 1, wherein:

said at least one control temperature sensor comprises a plurality of temperature sensors to be spaced apart throughout the appliance; and said comparing means includes means for averaging temperature measured by said plurality of sensors to provide an average ambient temperature and said comparing means compares said average temperature.

4. The diagnostic system according to claim 1 wherein said identifying and setting means comprises a system controller with control software and an error-detecting data structure in memory wherein said control software interrogates said data structure to provide a user error signal indicating location and possible cause of faulty operation in the cooking appliance.

5. The diagnostic system according to claim 1, further comprising means for aborting operation of the cooking appliance based on identification of a predetermined error condition.

6. The diagnostic system according to claim 1, wherein said temperature sensors comprise resistance temperature detectors such that the temperature measured by said error-detecting sensor when placed in proximity to said heating element represents, to a greater degree, direct heat from said element and, to a lesser degree, heat from air circulated around said element.

7. The diagnostic system according to claim 1, connected to and controlled by a system controller, which further controls cooking parameters in the appliance.

8. The diagnostic system according to claim 7, wherein said system controller comprises a microprocessor-based central processing unit with light-emitting diode (LED) or vacuum fluorescent device (VFD) display, electrically erasable programmable read-only ($E^2$PROM) memory or flash memory, and random-access memory (RAM).

9. The diagnostic system according to claim 1, wherein said predetermined or learned minimum and maximum temperature values are empirically determined based on selected cooking conditions.

10. The diagnostic system according to claim 9, wherein said selected cooking conditions comprise cold start, transient, steady state, and cooking load.

11. A multiple probe diagnostic system and cooking appliance comprising:

a cooking appliance housing;

at least one heating element disposed within said housing;

at least one error-detecting temperature sensor disposed in said housing to measure temperature at said heating element;

at least one control temperature sensor disposed in said housing at location spaced away from said at least one heating element to measure ambient-temperature within the housing;

means for comparing temperature measured at any of said sensors to predetermined or learned minimum and maximum values for said temperature at the respective sensor and providing first signals based thereon;

means for calculating temperature difference between two temperature sensors at two different locations and for comparing said difference to predetermined or learned minimum and maximum values for said difference in temperature between the respective sensors and providing a second signals based thereon; and means for identifying and setting error conditions in response to said first and second signals.

12. The diagnostic system and appliance according to claim 11 wherein said at least one error-detecting temperature sensor is disposed in proximity to said at least one heating element at a distance of about one-half inch to about five inches from said element.

13. The diagnostic system and appliance according to claim 12, wherein said distance is about two inches.

14. The diagnostic system and appliance according to claim 11, further comprising at least two heating elements disposed in said housing and wherein:

said at least one error-detecting temperature sensor comprises a first sensor disposed in proximity to a first heating element and a second sensor disposed in proximity to a second heating element; and said calculating means comprises means for calculating temperature difference between said first and second error-detecting sensors and generating said second signals based thereon.

15. The diagnostic system and appliance according to claim 11, wherein:

said at least one control temperature sensor comprises a plurality of temperature sensors spaced apart throughout the housing; and said comparing means includes means for averaging temperature measured by said plurality of sensors to provide an average ambient temperature and said comparing means compares said average temperature.

16. The diagnostic system and appliance according to claim 11, wherein:

said identifying and setting means comprises a system controller with control software and an error-recording data structure in memory, wherein said display control software interrogates said data structure to provide to a user error signals indicating location and possible cause of faulty operation in the cooking appliance.

17. The diagnostic system and appliance according to claim 14, wherein said heating elements are powered by electricity.

18. The diagnostic system and appliance according to claim 14, wherein said heating elements are powered by gas.

19. A multiple probe diagnostic system according to claim 11, wherein said system controller comprises a microprocessor-based central processing unit with light-emitting diode (LED) or vacuum fluorescent device (VFD) display, electrically erasable programmable read-only ($E^2$PROM) memory or flash memory, and random-access memory (RAM).

20. The diagnostic system and appliance according to claim 11, wherein said predetermined or learned minimum and maximum temperature values are empirically determined based on selected cooking conditions.

21. The diagnostic system and appliance according to claim 24, wherein said selected cooking conditions comprise cold start, transient, steady state, and cooking load.

22. The diagnostic system and appliance according to claim 11, further comprising means for aborting operation of the cooking appliance based on identification of a predetermined error condition.

23. A multiple probe diagnostic system and cooking appliance comprising:

a cooking appliance housing;

at least two heating elements disposed within said housing;

first and second error-detecting temperature sensors disposed in said housing and arranged to measure temperature at respective first and second heating elements;

at least one control temperature sensor disposed in said housing at a location spaced away from said at least two heating elements to measure ambient temperature within the housing;

means for comparing temperature measured at any of said sensors to predetermined or learned minimum and maximum values for said temperature at the respective sensor and providing first signals based thereon;

means for calculating a temperature difference between said first and second error-detecting sensors and for comparing said difference to predetermined or learned minimum and maximum values therefor and providing a second signal based thereon; and means for identifying and setting error conditions in response to said first and second signals;

wherein said appliance is a convection oven and comprises a forced air device whereby air is circulated within said housing and wherein at least one of said first and second heating elements is a convection element for heating circulated air.

24. The diagnostic system and appliance according to claim 23, wherein said first error-detecting sensors is positioned in proximity to the convection heating element such that the temperature measured by said first error-detecting sensor represents to a greater degree direct heat radiated by said element and to a lesser degree heat of the convection air circulated around said element.

25. The diagnostic system and appliance according to claim 24, wherein at least one of said first and second heating elements is a radiant heating element and said second error-detecting sensor measures temperature at said radiant heating element.

26. The diagnostic system and appliance according to claim 23 wherein said forced air device defines a return air stream and said at least one control temperature sensor is disposed in said return air stream.

27. A multiple probe diagnostic system and cooking appliance, comprising:

an appliance housing defining a cooking cavity and separate convection air flow passage;

two convection heating elements and at least one radiant heating element, wherein said convection elements are disposed in said air flow passage and said radiant element is disposed in said cooking cavity;

a forced air device to circulate air through said convection passage and throughout said housing;

error-detecting temperature sensors to measure temperature at each of said convection and radiant heating elements;

at least one control temperature sensor to measure ambient temperature at location spaced away from said heating elements;

means for comparing temperature measured by each of said error-detecting sensors to predetermined or learned minimum and maximum values for said temperature at the respective error-detecting sensor and providing a first signal based thereon;

means for calculating temperature difference between each of said error-detecting sensors and said control temperature sensor and for comparing said difference to predetermined or learned minimum and maximum values for said difference in temperature between the respective sensors and providing a second signal based thereon; and means for identifying and setting error conditions in response to said first and second signals.

28. The diagnostic system and appliance according to claim 27, wherein an error-detecting sensor is positioned in proximity to each said convection heating element such that the temperature measured by said sensors represents, to a greater degree, direct heat radiated by said convection heating element and, to a lesser degree, heat of the convection air circulated around said element.

29. The diagnostic system and appliance according to claim 28, wherein said forced air device defines a return air stream and said at least one control temperature sensor is disposed in said return air stream.

30. The diagnostic system and appliance according to claim 27, wherein:

said at least one control temperature sensor comprises a plurality of temperature sensors spaced apart throughout the oven cavity; and said comparing means includes means for averaging temperature measured by said plurality of sensors to provide an average ambient temperature and said comparing means compares said average temperature.

31. A method for diagnosing faulty operation of a cooking appliance including at least one heating element in a housing, said method comprising:

measuring temperature at said least one heating element;

measuring ambient temperature within said housing at location spaced away from said at least one heating element;

comparing temperature measured by said sensors to predetermined or learned minimum and maximum values for the temperature at the respective sensor and providing a first signal based thereon;

calculating temperature difference between two temperature sensors at two different locations and comparing said difference to predetermined or learned minimum and maximum values for said difference in temperature between the respective sensors and providing a second signal based thereon; and identifying and setting error conditions in said appliance in response to said first and second signals.

32. The method according to claim 31, further comprising the step of empirically determining and setting said predetermined or learned minimum and maximum temperature values based on selected cooking conditions, cold start, transient, steady state, and cooking load.

33. The method according to claim 32, further comprising aborting operation of the cooking appliance based on identification of a predetermined error condition.

34. The method according to claim 31 for diagnosing faulty operation in an appliance having at least two heating elements, comprising separately measuring temperature at said at least two heating elements and wherein said calculating step comprises calculating the difference between the temperatures measured at said heating elements.

35. The method according to claim 31 wherein said measuring ambient temperature comprises measuring temperature at a plurality at locations in said housing and calculating an average of said plurality.

36. A multiprobe diagnostic system for a cooking appliance including at least one heating element comprising:

at least one error-detecting temperature sensor to measure temperature at said heating element;

at least one control temperature sensor to measure ambient temperature within said appliance at location spaced away from said at least one heating element;

means for comparing temperature measured by any of said sensors to predetermined or learned minimum and maximum values for said temperature at the respective sensor and providing a first signal based thereon;

means for calculating temperature difference between two temperature sensors at two different locations and for comparing said difference to predetermined or learned minimum and maximum values for said difference in temperature between the respective sensors and providing a second signal based thereon;

means for measuring current to a subsystem of the appliance;

means for storing predetermined or learned values for current to a subsystem of the appliance;

means for comparing said measured current to said subsystem with predetermined or learned values for current to said subsystem and providing a third signal based thereon; and means for identifying and setting error conditions in response to said first, second, and third signals.

37. A multiple probe diagnostic system and cooking appliance comprising:

a cooking appliance housing;

at least one heating element disposed within said housing;

at least one error-detecting temperature sensor disposed in said housing to measure temperature at said heating element;

at least one control temperature sensor disposed in said housing at location spaced away from said at least one heating element to measure ambient-temperature within the housing;

means for comparing temperature measured at any of said sensors to predetermined or learned minimum and maximum values for said temperature at the respective sensor and providing first signals based thereon;

means for calculating temperature difference between two temperature sensors at two different locations and for comparing said difference to predetermined or learned minimum and maximum values for said difference in temperature between the respective sensors and providing a second signals based thereon;

means for measuring current to a subsystem of the appliance;

means for storing predetermined or learned values for current to a subsystem of the appliance;

means for comparing said measured current to said subsystem with predetermined or learned values for current to said subsystem and providing a third signal based thereon; and means for identifying and setting error conditions in response to said first, second, and third signals.

38. A multiple probe diagnostic system and cooking appliance, comprising:

an appliance housing defining a cooking cavity and separate convection air flow passage;

two convection heating elements and at least one radiant heating element, wherein said convection elements are disposed in said air flow passage and said radiant element is disposed in said cooking cavity;

a forced air device to circulate air through said convection passage and throughout said housing;

error-detecting temperature sensors to measure temperature at each of said convection and radiant heating elements;

at least one control temperature sensor to measure ambient temperature at location spaced away from said heating elements;

means for comparing temperature measured by each of said error-detecting sensors to predetermined or learned minimum and maximum values for said temperature at the respective error-detecting sensor and providing a first signal based thereon;

means for calculating temperature difference between each of said error-detecting sensors and said control temperature sensor and for comparing said difference to predetermined or learned minimum and maximum values for said difference in temperature between the respective sensors and providing a second signal based thereon;

means for measuring current to a subsystem of the appliance;

means for storing predetermined or learned values for current to a subsystem of the appliance;

means for comparing said measured current to said subsystem with predetermined or learned values for current to said subsystem and providing a third signal based thereon; and means for identifying and setting error conditions in response to said first, second, and third signals.

39. A method for diagnosing faulty operation of a cooking appliance including at least one heating element in a housing, said method comprising:

measuring temperature at said least one heating element;

measuring ambient temperature within said housing at location spaced away from said at least one heating element;

comparing temperature measured by said sensors to predetermined or learned minimum and maximum values for the temperature at the respective sensor and providing a first signal based thereon;

calculating temperature difference between two temperature sensors at two different locations and comparing said difference to predetermined or learned minimum and maximum values for said difference in temperature between the respective sensors and providing a second signal based thereon;

measuring current to a subsystem of the appliance;

storing predetermined or learned values for current to a subsystem of the appliance;

comparing said measured current to said subsystem with predetermined or learned values for current to said subsystem and providing a third signal based thereon; and identifying and setting error conditions in said appliance in response to said first, second, and third signals.

40. A multiprobe diagnostic system for a cooking appliance having at least first and second heating elements, said system comprising:

first and second temperature sensors arranged to measure temperature proximate to respective first and second heating elements;

means for comparing temperature measured by said sensors to predetermined or learned minimum and maximum values for each sensor and providing first signals based thereon;

means for calculating a first temperature difference between first and second temperature sensors and for comparing said first temperature difference to predetermined or learned minimum and maximum values therefor, and providing a second signal based thereon; and means for identifying and setting error conditions in response to said first and second signals.

41. A multiprobe diagnostic system according to claim 40, further comprising:

at least one control temperature sensor arranged to measure ambient temperature at a position away from said first and second heating elements;

means for comparing said ambient temperature to predetermined or learned minimum and maximum values therefor, and providing a third signal based thereon; and means for identifying and setting error conditions in response to said third signal.

42. A multiprobe diagnostic system according to claim 41, further comprising:

means for comparing said ambient temperature to the temperature measured by both of said first and second sensors and providing a fourth signal based thereon; and means for identifying and setting error conditions in response to said fourth signal.

43. A multiprobe diagnostic system according to claim 40, wherein said first and second temperature sensors comprise resistance temperature detectors arranged such that their measured temperature represents, to a greater degree, direct heat from said element and, to a lesser degree, heat from a medium circulating around said element.

44. A multiprobe diagnostic system according to claim 40, further comprising:

means for measuring current to a motor of the appliance;

means for storing predetermined or learned values for current to said motor;

means for comparing said measured current with predetermined or learned values and providing a third signal based thereon; and means for identifying and setting error conditions in response to said first, second, and third signals.

45. A cooking appliance comprising:

a cooking housing having at least first and second heating elements disposed therein; and a multiprobe diagnostic system associated with said appliance, said system comprising:

first and second temperature sensors arranged to measure temperature proximate to respective first and second heating elements;

means for comparing temperature measured by said sensors to predetermined or learned minimum and maximum values for each sensor and providing first signals based thereon;

means for calculating a first temperature difference between first and second temperature sensors and for comparing said first temperature difference to predetermined or learned minimum and maximum values therefor, and providing a second signal based thereon; and means for identifying and setting error conditions in response to said first and second signals.

46. A method for diagnosing faulty operation of a cooking appliance having at least first and second heating elements in a housing, said method comprising the steps of:

measuring temperature at a position proximate said first and second heating elements;

comparing temperature measured by said sensors to predetermined or learned minimum and maximum values for each sensor and providing first signals based thereon;

calculating a first temperature difference between first and second temperature sensors and comparing said first temperature difference to predetermined or learned minimum and maximum values therefor, and providing a second signal based thereon; and identifying and setting error conditions in response to said first and second signals.

47. The method of claim 46, further comprising the steps of:

measuring ambient temperature within said housing at a location spaced away from said heating elements;

comparing said ambient temperature to predetermined or learned minimum and maximum values therefor, and providing a third signal based thereon; and identifying and setting error conditions in response to said third signal.

48. The method of claim 47, further comprising the steps of:

comparing said ambient temperature to the temperature measured by both of said first and second sensors and providing a fourth signal based thereon; and identifying and setting error conditions in response to said fourth signal.

* * * * *